United States Patent [19]

Gale et al.

[11] 3,970,445

[45] July 20, 1976

[54] WEAR-RESISTANT ALLOY, AND METHOD OF MAKING SAME

[75] Inventors: Preston L. Gale, Chillicothe; Eugene L. Helton, Peoria, both of Ill.; Robert C. Mueller, Mentor, Ohio

[73] Assignee: Caterpillar Tractor Co., Peoria, Ill.

[22] Filed: May 2, 1974

[21] Appl. No.: 466,141

[52] U.S. Cl. ..... 75/0.5 B; 75/.5 BA; 75/.5 BC; 75/.5 C; 75/126 P; 75/176; 264/11; 264/13

[51] Int. Cl.[2] ..... B22D 23/08

[58] Field of Search ..... 75/126 P, 176, .5 B, 75/.5 BA, .5 C, .5 BC; 264/11, 13

[56] References Cited

UNITED STATES PATENTS 2,567,121 9/1951 Olsen ..... 264/11

FOREIGN PATENTS OR APPLICATIONS 273,640 6/1970 U.S.S.R. ..... 75/126 P

*Primary Examiner*—W. Stallard
*Attorney, Agent, or Firm*—Phillips, Moore, Weissenberger Lempio & Strabala

[57] ABSTRACT

A wear-resistant alloy comprising boron, chromium and iron having maximum hardness for a given composition is produced by rapidly cooling and solidfying spheroidal particles of the molten alloy mixture. The resultant solid particles are then cast in the desired form, or incorporated into a composite alloy wherein the solid particles are held together with a matrix of different material from the alloy.

4 Claims, 2 Drawing Figures

WEAR-RESISTANT ALLOY, AND METHOD OF MAKING SAME

BACKGROUND OF THE INVENTION

This invention relates to a wear-resistant or abrasive resistant alloy, and method of producing this alloy. The invention particularly relates to such an alloy suitable for use in highly abrasive environments.

Ground-engaging tools such as ripper tips, bucket teeth and cutting edges for various types of earth-working machines are all subject to accelerated wear during working of the machines due to continual contact of these parts with rock, sand and earth. It is therefore desirable that these tools be comprised of a highly wear-resistant material, e.g., U.S. Pat. Nos. 1,493,191; 3,275,426 and 3,334,996 and further, that such material be relatively inexpensive to thereby minimize the cost when replacement inevitably becomes necessary; note, for instance, British Pat. No. 1,338,140.

Many wear-resistant alloys have been developed for use in such tools and for other uses demanding an alloy of high abrasive resistance. Many such alloys, however, are composed of materials which are not readily available, or are expensive, or both. One such example is tungsten carbide which has excellent wear-resistant properties, but which is relatively expensive. Additionally, particularly in the case of tool manufacture, it is frequently important that the wear-resistant alloy be substantially unimpaired by heat treatment. For example, a convenient method of joining a metal part composed of a wear-resistant alloy to a steel ground-engaging tool is by brazing; this process, however, usually weakens the steel of the tool, making it necessary to heat-treat the steel to strengthen it. Many alloys are adversely affected by such heat treatment, and either cannot be used under these circumstances, or the steel cannot be treated to harden. Frequently, also, known wear-resistant alloys are unsuitable for use with tools which are subjected to frequent shocks, since, typically, these wear-resistant hard alloys are brittle, and readily break under shock treatment.

Accordingly, it is an object of this invention to provide a specially treated inexpensive wear-resistant alloy comprised of readily available elements.

It is another object of this invention to provide a method of producing a highly wear-resistant alloy.

BRIEF SUMMARY OF THE INVENTION

According to this invention, a wear-resistant alloy of boron, chromium, and iron is provided and optimum hardness of the alloy is obtained by forming the alloy into substantially spheroidal particles which may then be cast into a desired shape, or distributed within a matrix of another alloy material to form a "composite" alloy.

As used herein the terms "composite" or "composite alloy" means an alloy material wherein two or more metallurgically distinct alloys are first prepared physically separate one from the other. These separate alloys are then physically mixed together, generally in the "dry" state, and at ambient temperatures to produce an homogeneous mixture thereof. This alloys mixture is then subjected to heat processing wherein a temperature is achieved sufficiently high to cause at least one of the alloys to experience "melting" or at least incipient "melting" and to thereby "braze" the mixture into a single physical mass. It should be understood that at least one of the alloy components remains essentially physically unchanged during the "brazing" step.

The resulting "composite" alloy, although in a single mass, contains both the original alloys in distinctly segregated portions within the mass, and both alloys continue to exhibit their individual metallurgical properties on an individual basis, although the "composite" alloy, as a whole, exhibits its separate and individual metallurgical and physical properties as well.

DETAILED DESCRIPTION OF THE INVENTION

Figure 1:
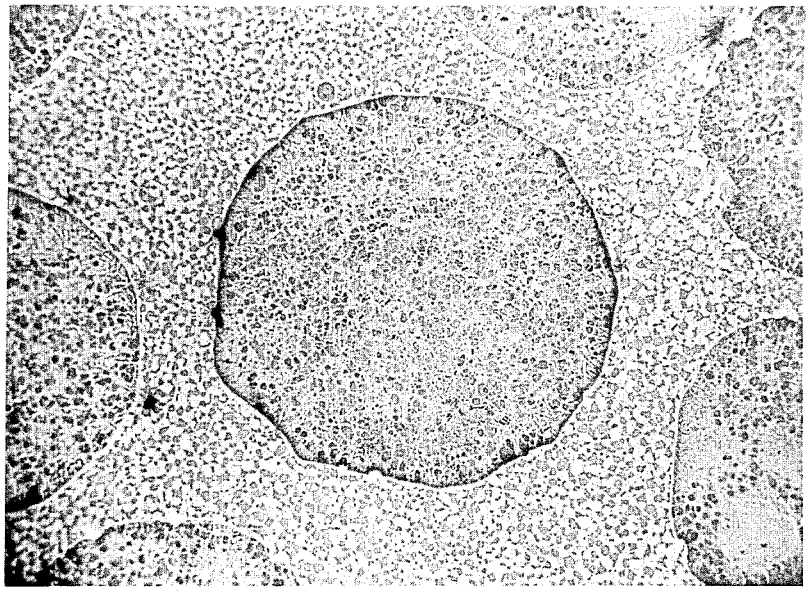
FIG. 1 is a photomicrograph of alloy particles of this invention embedded in an alloy matrix. (magnification — 50×).

The invention comprises a wear-resistant alloy comprised of relatively low cost, readily available elements, that are alloyed and then processed to yield extremely hard wear-resistant particles, especially spheroids. These spheroidal particles may be "brazed" together or alternately incorporated into a composite alloy that comprises the spheroidal particles in a strong ductile alloy matrix. These composite alloys and tools reinforced therewith are claimed in Application Ser. No. 466,142, entitled "Composite Wear-Resistant Alloy, and Tools from Same", filed on even date with this application and assigned to the same assignee.

The wear-resistant alloy portion of the invention is essentially an iron-chromium based alloy with boron therein.

More particularly, the alloy of the invention substantially comprises boron, chromium and iron in the following amounts per cent by weight:

| | |
|---|---|
| Boron | about 6.0 to about 12% |
| Chromium | about 25 to about 61% |
| Iron | balance |

This combination of elements, in the portions indicated, gives a complex mixture of iron and chromium borides having extremely high hardness values, typically from about 1200 to about 1600 kg/mm$^2$ Knoop (or above about 70 on the Rockwell C hardness scale). Although it would normally be expected that the high percentages of boron and chromium defined by the above ranges would result in an extremely brittle alloy composition, this is not really the case with the alloy of the invention. It is likely that this can be attributed to the high percentages of iron in the alloy, which forms an iron phase to give the necessary ductility to the alloy composition.

An alloy, quite similar to the above-noted composition, is also useful as the wear-resistant component in the invention. Specifically boron, chromium, iron and carbon in the ranges:

| | |
|---|---|
| Boron | 6.0 to about 12% |
| Chromium | 61 to about 70% |
| Carbon | 0.05 to about 2% |
| Iron | balance |

exhibits extreme hardness when processed into shot as described below.

This can be effectively accomplished by a method comprising pouring the molten alloy mixture onto a surface of material, such as graphite, at ambient temperatures, and which is positioned over a container of liquid coolant. Preferably, the molten mixture is poured in a stream from a suitable height (about 4 to 5 feet) above the cool surface. Conveniently, the liquid coolant may be water, or other suitable liquid. The liquid coolant is arranged to a depth sufficient to assure complete solidification of the alloy particles before they reach the bottom of the quenching liquid.

On striking the cold surface, the molten mixture explodes into thousands of spheroidal particles of various sizes, which immediately fall into the container of coolant where they cool and solidify very rapidly.

High alloy compositions formed by this method exhibit properties of high strength and high hardness, with concomitantly high resistance to wear. The extreme hardness and strength of these alloy particles are thought to be at least in part due to the surface tension set up in the particles as they form into spheroids after contacting the cold surface.

The relative hardness of the alloy particles produced by the above method has been compared by tests with similarly sized alloy particles of the same chemistry produced by conventional methods. For example, in one test, solid slugs having an alloy composition of 25% Cr, 8.8% B, and 66.2% Fe were broken up and screened to give particles of 10 to 20 mesh, which were found to have a Knoop hardness of about 1100 Kg/mm$^2$ (500 gm. load). Similarly sized particles of the same composition produced by the exploding method described above were found to have Knoop hardness of about 1400 Kg/mm$^2$ (500 gm. load).

In a similar test utilizing an alloy composition of 40% Cr, 10 B and 50 Fe, the particles produced by breaking up a solid casting had a Knoop hardness of 1200 to 1300 Kg/mm$^2$ (500 gm. load), whereas the exploded particles had a Knoop hardness of 1500 to 1600 Kg/mm$^2$ (500 gm. load).

Even harder spheroidal particles have been produced from the alloy compositions including up to 2% carbon in addition to the boron, chromium and iron. One composition of about 62.5% Cr, 9% B, 1.8% C and Fe remainder produces a eutectic metallurgical structure of chromium borides and iron carbides. Alloys in this range of composition have yielded shot with a hardness range of 1700–2000 Knoop Kg/mm$^2$ (100 gm. load).

After solidification, the spheroidal alloy particles are removed from the liquid coolant. They are then most advantageously plated with a protective metal, particularly when the particles are to be subsequently brazed with a matrix alloy to form a desired composition alloy. This metal plating serves to protect the alloy from oxidation during storage and further serves to retard to some extent bonding of the particles with the substrate during brazing, thereby preventing alloy diffusion into this substrate. Diffusion tends to erode the hard spheroids and further degrades the desired crystalline structure of the shot particles, at least in the peripheral portions thereof. Suitably, the alloy particles are plated with nickel, although other metals which will provide the desired protection, such as copper or chromium, can be used.

The plating may be a conventional electro-plating method. The spheroidal particles are placed in a container such as a barrel with openings therein covered with fine mesh screens to retain the small particles within the container. The container is then submerged in a metallic plating solution, e.g. Ni and rotated therein while electric current is applied. The plating solution can flow freely through the rotating barrel to reach all the particles therein. A metal coating of about 0.001 to about 0.003 inches is sufficient to retard oxidation and to minimize erosion by matrix alloy during the sintering or brazing step in production of composite alloys.

The spheroidal alloy particles may be formed, with or without plating by compacting, into a homogeneous block of the desired shape. Also, the particles may either be cast in place in the desired location, or may be cast separately, and then bonded in position. In addition, the alloy particles may be incorporated into a matrix of another material. While generally, greater hardness and strength results from a body comprised solely of the spheroidal alloy particles, it is frequently advantageous to provide a composite body of alloy particles and matrix material; for example, a composite alloy of spheroidal particles and strong, ductile matrix material is desirable if greater shock absorption capacity is desired.

Figure 2:
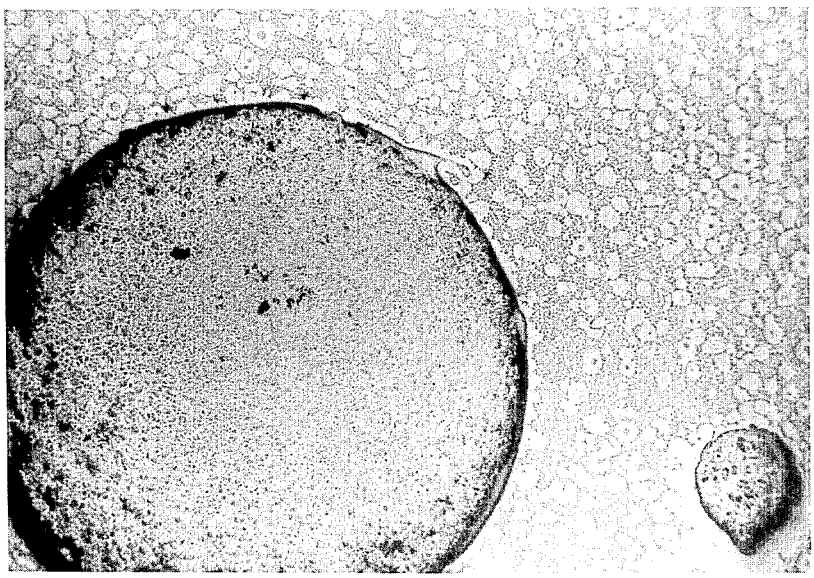
FIG. 2 is another photomicrograph of alloy particles of this invention embedded in an alloy matrix. (magnification — 100×).

FIGS. 1 and 2 of the drawing are photomicrographs of the composite alloy of the invention. They clearly show the spheroidal wear-resistant alloy particles. FIG. 1 shows spheroidal particles that have a composition of 35% Cr, 10.9% B, remainder iron. The thin nickel plate surrounding the wear-resistant sphere is also apparent. FIG. 2 is also a photomicrograph of a specimen of composite alloy. The spheroidal particle was analyzed at 50% Cr, 10.9% B and the remainder Fe. The spheroidal particle was also nickel plated.

The following Example is provided as an illustration of the method and composition of this invention.

EXAMPLE

Hard particles were made from a mixture of Armco Ingot Iron, electrolytic chromium and ferro-boron melted in an induction furnace at 2600°–2700°F. The resultant composition of the wear resisting alloy was iron 66%, chromium 25%, and boron 9%. The molten alloy was dropped about 3 feet onto a slanted graphite plate located just above a tank filled with water. As the molten alloy stream struck the graphite plate, it was broken into various size particles. When it entered the water, the alloy solidified forming spheroidal particles. The process above resulted in cast spheroidal particles comprised principally of borides with a Knoop Hardness Number of 1400 and above. These particles were then electrolytically cleaned and then coated with a nickel plate to retard surface oxidation and improve matrix alloy bonding.

What is claimed is:

1. A method for improving the hardness characteristics of an alloy consisting essentially of about 25 to about 61% by weight chromium, about 6 to about 12% by weight boron, and the balance iron comprising the steps of producing cast spheroidal particles thereof by streaming the molten alloy onto a hard surface thus breaking up the molten alloy into droplets and thereafter rapidly quenching and solidifying the molten alloy with a quench liquid while still in the droplet configuration.

2. A method for improving the hardness characteristics of an alloy consisting essentially of about 61 to about 70% by weight chromium, about 6 to about 12% by weight boron, about 0.05 to about 2% carbon, and the balance iron comprising the steps of producing cast spheroidal particles thereof by streaming the molten alloy onto a hard surface thus breaking up the molten alloy into droplets and thereafter rapidly quenching and solidifying the molten alloy with a quench liquid while still in the droplet configuration.

3. A wear-resistant alloy comprising about 61 to about 70% by weight chromium, about 6 to about 12% by weight boron, about 0.05 to about 2% carbon, and the balance iron in the form of cast spheroidal particles.

4. A wear-resistant alloy consisting essentially of about 25 to about 61% by weight chromium, about 6 to about 12% by weight boron, and the balance iron, in the form of cast spheroidal particles having a Knoop hardness at least about 200 $Kg/mm^2$ greater than said alloy in ingot form.

* * * * *